US010358819B2

(12) United States Patent
Tanami

(10) Patent No.: US 10,358,819 B2
(45) Date of Patent: Jul. 23, 2019

(54) CONSTRUCTION BLOCK, A WALL STRUCTURE COMPRISING THE SAME, AND A METHOD FOR MANUFACTURE OF SAID CONSTRUCTION BLOCK AND OF SAID WALL STRUCTURE

(71) Applicant: Yonathan Tanami, D.N. Golan Heights (IL)

(72) Inventor: Yonathan Tanami, D.N. Golan Heights (IL)

( * ) Notice: Subject to any disclaimer, the term of this patent is extended or adjusted under 35 U.S.C. 154(b) by 0 days.

(21) Appl. No.: 15/744,495

(22) PCT Filed: Jun. 30, 2016

(86) PCT No.: PCT/IL2016/050705
§ 371 (c)(1),
(2) Date: Jan. 12, 2018

(87) PCT Pub. No.: WO2017/009821
PCT Pub. Date: Jan. 19, 2017

(65) Prior Publication Data

US 2018/0195281 A1 Jul. 12, 2018

(30) Foreign Application Priority Data

Jul. 16, 2015 (IL) ..... 239976

(51) Int. Cl.
*E04B 1/78* (2006.01)
*E04B 2/02* (2006.01)
(Continued)

(52) U.S. Cl.
CPC ..... *E04C 1/40* (2013.01); *E04B 2/18* (2013.01); *E04C 1/397* (2013.01); *E04C 3/29* (2013.01);
(Continued)

(58) Field of Classification Search
CPC ... E04C 1/40; E04C 3/29; E04C 1/397; E04C 1/00; E04C 2003/023; E04B 2/18; E04B 2002/0245; E04B 2002/0256; E04B 1/78
See application file for complete search history.

(56) References Cited

U.S. PATENT DOCUMENTS 142,475 A 9/1873 Hyatt
2,881,613 A 4/1959 Taylor et al.
(Continued)

FOREIGN PATENT DOCUMENTS

CN 203247749 10/2013
CN 203924462 11/2014
(Continued)

OTHER PUBLICATIONS

International Search Report and Written Opinion for International Application No. PCT/IL2016/050705 dated Sep. 5, 2016.

*Primary Examiner* — Rodney Mintz
(74) *Attorney, Agent, or Firm* — Dorsey & Whitney LLP

(57) ABSTRACT

A construction block comprising: two or more support members each of which has a first face and a second face opposite the first face and comprises a hollow between the first and second faces, said hollow having openings facing in a direction transverse to a direction normal to the first and second faces, said opening configured for receiving at least a portion of a tenon element allowing two such construction blocks to be assembled; a frame arrangement connecting the support members to each other, said frame arrangement having external segment(s) extending from at least one of the first and second faces in a direction away from the hollow; a first panel conterminous with the first faces; and a second panel conterminous with the second faces; wherein at least a portion of the external segment of the frame arrangement is contained within one of the first and second panels.

20 Claims, 7 Drawing Sheets

(51) Int. Cl.

| | |
|---|---|
| ***E04B 2/18*** | (2006.01) |
| ***E04C 1/39*** | (2006.01) |
| ***E04C 1/40*** | (2006.01) |
| ***E04C 3/02*** | (2006.01) |
| ***E04C 3/29*** | (2006.01) |

(52) U.S. Cl.
CPC ..... *E04B 1/78* (2013.01); *E04B 2002/0245* (2013.01); *E04B 2002/0256* (2013.01); *E04B 2002/0263* (2013.01); *E04C 2003/023* (2013.01)

(56) References Cited

U.S. PATENT DOCUMENTS

| | | | | |
|---|---|---|---|---|
| 3,936,987 | A | 2/1976 | Calvin | |
| 4,207,718 | A | 6/1980 | Schaaf et al. | |
| 4,337,605 | A | 7/1982 | Tudek | |
| 5,209,037 | A | 5/1993 | Kennedy et al. | |
| 5,379,565 | A * | 1/1995 | Vienne | E04B 2/18 52/605 |
| 5,596,853 | A * | 1/1997 | Blaney | E04C 2/044 52/223.7 |
| 5,715,635 | A | 2/1998 | Sherwood | |
| 5,809,732 | A * | 9/1998 | Farmer, Sr. | B28B 7/183 52/600 |
| 5,839,243 | A | 11/1998 | Martin | |
| 6,032,424 | A * | 3/2000 | Dial, Jr. | B22C 9/24 249/96 |
| 6,223,491 | B1 * | 5/2001 | Dial, Jr. | B22C 9/24 264/247 |
| 6,282,853 | B1 * | 9/2001 | Blaney | E04C 2/044 52/223.7 |
| 8,646,239 | B2 * | 2/2014 | Rulon | E04B 2/50 52/223.7 |
| 9,175,469 | B2 * | 11/2015 | Toopchinezhad | B28B 7/183 |
| 9,194,125 | B1 * | 11/2015 | Romanenko | E04C 1/40 |
| 9,523,201 | B2 * | 12/2016 | Romanenko | E04B 1/04 |
| 9,828,769 | B2 * | 11/2017 | Ariba | E04B 2/14 |
| 10,106,980 | B2 * | 10/2018 | Martinez | E04B 2/18 |
| 2002/0083658 | A1 | 7/2002 | Dial, Jr. | |
| 2002/0124509 | A1 * | 9/2002 | Smyer, III | E04B 2/02 52/439 |
| 2003/0029107 | A1 | 2/2003 | Ritter et al. | |
| 2004/0020145 | A1 | 2/2004 | Matsufuji | |
| 2005/0252134 | A1 * | 11/2005 | Makovich | E04C 1/40 52/503 |
| 2006/0156673 | A1 | 7/2006 | Nakamura | |
| 2006/0168907 | A1 * | 8/2006 | Thorpe | E04B 2/16 52/309.12 |
| 2007/0234660 | A1 | 10/2007 | Humphrey et al. | |
| 2008/0172973 | A1 | 7/2008 | Williams et al. | |
| 2011/0167749 | A1 | 7/2011 | Azizi Ronagh | |
| 2011/0258957 | A1 | 10/2011 | Virnich | |
| 2013/0247497 | A1 | 9/2013 | Toopchinezhad et al. | |
| 2013/0326967 | A1 * | 12/2013 | Kim | B66C 1/666 52/125.4 |
| 2014/0090325 | A1 | 4/2014 | Maeers | |
| 2014/0150361 | A1 | 6/2014 | Castonguay et al. | |
| 2015/0159371 | A1 * | 6/2015 | Rodriguez Carassus | E04B 2/06 52/204.2 |
| 2016/0076246 | A1 * | 3/2016 | Romanenko | E04B 1/04 52/204.1 |
| 2016/0281357 | A1 * | 9/2016 | Aribas | E04B 2/14 |
| 2016/0362889 | A1 * | 12/2016 | Pfeffer | E04C 1/00 |
| 2018/0044914 | A1 * | 2/2018 | Martinez | E04B 2/18 |
| 2018/0245345 | A1 * | 8/2018 | Pfeffer | E04C 1/00 |
| 2019/0063065 | A1 * | 2/2019 | Gheni | E04C 1/40 |

FOREIGN PATENT DOCUMENTS

| | | |
|---|---|---|
| DE | 1913658 | 11/1970 |
| DE | 4335237 | 6/1994 |
| EP | 0479816 A1 | 4/1992 |
| EP | 0647746 | 4/1995 |
| FR | 2589501 | 5/1987 |
| FR | 2608655 | 6/1988 |
| NL | 1006452 | 1/1999 |
| WO | W02010/105317 | 9/2010 |

* cited by examiner

CONSTRUCTION BLOCK, A WALL STRUCTURE COMPRISING THE SAME, AND A METHOD FOR MANUFACTURE OF SAID CONSTRUCTION BLOCK AND OF SAID WALL STRUCTURE

TECHNOLOGICAL FIELD

The present invention is in the field of construction blocks, in particular, modular blocks which are configured for quick assembly during a construction process.

BACKGROUND

A Structural insulated panel (or structural insulating panel), SIP, are a composite building material. They consist of an insulating layer of rigid core sandwiched between two layers of structural board. The board can be sheet metal, plywood, cement, magnesium oxide board (MgO) or oriented strand board (OSB) and the core either expanded polystyrene foam (EPS), extruded polystyrene foam (XPS), polyisocyanurate foam, polyurethane foam or composite honeycomb (HSC).

SIPs share the same structural properties as an I-beam or I-column. The rigid insulation core of the SIP acts as a web, while the sheathing fulfills the function of the flanges. SIPs combine several components of conventional building, such as studs and joists, insulation, vapor barrier and air barrier. They can be used for many different applications, such as exterior wall, roof, floor and foundation systems.

It is common to use SIP to construct walls during conventional building. There are various ways of constructing a wall structure using insulated panels and method for connecting panels to one another.

Examples of such constructions can be found in:

EP0647746;

CN203247749 which is directed to a brick provided with inserted structure;

DE1913658 which is directed to hollow ingot elements with a side panel to opposite crossing chambers;

DE4335237 which is directed to a system of building blocks made from scrap plastics;

U.S. Pat. No. 5,715,635 which is directed to a building block unit and method of manufacturing same;

WO2010/105317 which is directed to an arrangement introduced into a kit of lightweight components for erecting various kinds of walls;

FR2589501 which is directed to a combined construction block and positive connection member; and FR2608655 which is directed to a building block and construction obtained with the said block.

Acknowledgement of the above references herein is not to be inferred as meaning that these are in any way relevant to the patentability of the presently disclosed subject matter.

GENERAL DESCRIPTION

According to a first aspect of the subject matter of the present application there is provided a construction block comprising:

two or more support members, each support member having a first face and a second face opposite the first face and comprises a hollow between the first and second faces, said hollow having at least one opening facing in a direction transverse to a direction normal to the first and second faces, said opening being configured for receiving therethrough at least a portion of a tenon element allowing two such construction blocks to be mutually assembled using said tenon element via said openings;

a frame arrangement connecting the two or more support members to each other, said frame arrangement having at least one external segment extending from at least one of the first and second faces in a direction away from the hollow;

a first panel conterminous with the first faces of the two or more support members; and a second panel conterminous with the second faces of the two or more supports members;

wherein at least a portion of the external segment of the frame arrangement is contained within one of the first and second panels.

The term 'conterminous with' should be broadly understood in the context of the present application as being such that one or more of the panels has a portion thereof which is set against at least one of the corresponding surfaces of the support member, regardless of the manner at which the panels are held in place. Specifically, the panels can be attached, fitted, adhered, cast or molded to the two or more support members.

Each of said support members can be in the form of a sheet structure or profile, i.e. made of a sheet which was formed or folded to assume the shape of the support member. In particular, the sheet structure can be made of a material chosen such that can properly support the weight of the first and second panel, when formed thereon. Specifically, the structure can be a sheet-metal structure, and in accordance with a specific example, be made of steel.

The hollow can extend the entire length of the support member and have a first opening at a top portion of the support member and a second opening at a bottom portion of the support member. As will be further discussed, since the construction block can be used in the construction of a wall structure, having both a top and a bottom opening for the hollow can allow a more versatile assembly and arrangement of different constructions blocks to one another.

In addition, at least one of the two or more support members can comprise a first side wall with a first side opening and a second side wall opposite the first side wall, with a second side opening, defining a cross-channel between the first and the second side wall. The cross-channel can be configured for passing therethrough of piping and/or wiring within the construction block. The arrangement can be such that said cross-channel is not obstructed by the first and the second panel, extending in a direction transverse thereto.

The frame arrangement can be made of a rigid material configured for holding the support members in fixed relation with respect to one another. In accordance with a specific example, the frame arrangement can be made of metal. The frame arrangement can be fixedly attached to the two or more support members in a variety of ways, for example, by welding.

The two or more support members can be spaced apart, so that the construction block comprises at least one internal cavity defined between the support members, thereby reducing the overall density and weight of the construction block (as compared to that of a construction block which is filled solid.

In accordance with a particular example, the first faces of the two or more support members can be oriented flush with respect to each other and the second faces of the two or more support members can also be oriented flush with respect to each other, respectively defining a first mating plane and a second mating plane.

According to a specific design of the construction block, any one of the following features may apply:

- at least one of the two or more support members can comprise a pin slot configured for receiving therein a securing pin, which can extend along one of the side faces of the support member; and
- at least one of the two or more support members can comprise a securing pin, which can extend along one of the side faces of the support member.

In a construction block comprising more than two support members arranged along a longitudinal dimension of the construction block, a support member having one or more neighboring support members on both sides thereof (along the longitudinal dimension) can be defined as an intermediate support member and a support member which has one or more neighboring support members on only one side thereof (along the longitudinal dimension), can be defined as an end support member.

The pin slot or securing pin can be formed at an external side wall of an end support member, so that when two construction blocks are arranged side-by-side, the securing pin of one of the two support members is configured for being received within a pin slot of the other of the two support members.

According to one example, the construction block can comprise four support members arranged such that the two of the four support members are spaced apart from one another defining a space, and serving as end support members, and the other two support members are disposed within in said space. The other two support members can be conjoined, forming a single unit, which may be centrally disposed within said space between the first two end support members.

The shape of the construction block is not limited to a longitudinal block and can assume an L-shaped design, comprising two end support members, each disposed at a different end point of the L-shape, and a third, intermediate support member disposed at the corner of the L-shape. The construction block can also assume other shapes and designs, for example, a T-shape comprising three end support members, each disposed at a different end point of the T-shape, and one intermediate support member disposed at the intersection of the T-shape.

In accordance with a particular example, said construction block can comprise a plurality of support members including a first end support member and a second end support member spaced apart from one another to define a space, and a plurality of support member pairs, each comprising two conjoined support members, disposed sequentially in said space.

In accordance with another aspect of the subject matter of the present application, there is provided a wall structure comprising two or more construction blocks according to the previous aspect of the application, said wall structure further comprising at least one tenon element having a first portion thereof received in a hollow of one of the two or more support members of a first of the two or more construction blocks and a second portion thereof received in a hollow of one or more of the two support members of a second of the two or more construction blocks, thereby holding them together.

The construction blocks can be arranged without offset such that the first portion of the tenon is received within a hollow of a first support member of a first of the two or more construction blocks through a top opening thereof and a second portion thereof is received in a hollow of a corresponding first support member of a second of the two or more construction blocks through a bottom opening thereof, thereby holding them together. Alternatively, the construction blocks can be arranged at an offset with respect to one another, such that the first portion of the tenon is received within a hollow of a first support member of a first of the two or more construction blocks through a top opening thereof, and a second portion thereof received in a hollow of a support member of a second of the two or more construction blocks different than the first support member thereof, through a bottom opening thereof.

In accordance with one example, said wall structure can further comprise a securing pin having a first portion thereof received within a pin slot of a support member of a first of the two or more construction blocks and a second portion thereof received in a pin slot of a support member of a second of the two or more construction blocks, thereby preventing detachment between the first block and the second block.

In accordance with another example, as mentioned above, each construction block can comprise a pin slot at one of the end support members thereof and a securing pin at the other of the end support members so that when two construction blocks are aligned side-by-side, the securing pin of one construction block fits into the pin slot of the neighboring construction block.

The wall structure can further comprise a ground base configured for positioning thereon a first row of construction blocks, said base comprising a longitudinal plate formed with one or more base tenon elements disposed therealong and configured for being received within corresponding hollows of the support members through a bottom opening thereof.

In addition, the wall structure can comprise a top closure piece configured for being mounted over a top row of construction blocks to cover a top portion thereof, including the top openings of the hollows of the support members thereof.

It is appreciated that when a plurality of such construction blocks are arranged to form a wall structure, and specifically, when they are arranged one on top of the other, regardless if they are aligned or at an offset with respect to one another, the hollows of the support members form continuous longitudinal support channels extending transverse to the longitudinal dimension of the construction blocks (for a vertical wall structure, these channels will extend vertically). A plurality of tenon elements can be received within each such support channel, each tenon bridging between two neighboring construction blocks, and resting on the vertically neighboring tenon position below it. Under such a construction, the tenon elements serve together as a load-bearing support pillar for the entire wall structure.

It is appreciated, however, that for a wall structure comprising a plurality of construction blocks as described above, the arrangement can be such that not each of the support channels has to receive and contain tenon elements therein. In particular, for construction blocks which support channels are not filled with tenon elements, the securing pins (and their insertion into corresponding pin slots) can provide a solution for fixing the construction blocks to one another.

In accordance with another aspect of the subject matter of the present application, there is provided a method for the assembly of a wall structure according to the previous aspect, said method comprising the steps of:

providing two or more construction block according to the first aspect of the present application;

inserting a first portion of at least one tenon element into a hollow of a support member of the first of the two or more construction blocks through a top opening thereof; and placing a second of the two or more construction blocks over the first of the two or more construction blocks so that a second portion of the tenon element is received within a hollow of a support member of the second of the two or more construction blocks through a bottom opening thereof, to form at least part of the wall structure.

The method can also include the step of inserting a securing pin into the wall structure so that a first portion thereof is received within a pin slot of a support member of the first of the two or more construction blocks and a second portion thereof is received within a pin slot of a support member of the second of the two or more construction blocks. Alternatively, the step placing, when two construction blocks are positioned side-by-side, the second of the two or more construction blocks so that a securing pin on one end thereof is received within a pin slot of a corresponding end of the first of the two or more constructions blocks.

The method can further include a preliminary step of:

providing a ground base configured comprising a longitudinal plate formed with one or more base tenon elements disposed therealong and configured for being received within corresponding hollows of the support members through a bottom opening thereof; and positioning at least one construction block on said ground base so that the hollows of the two or more support members receive therein a portion of the base tenon elements through their bottom openings.

The method can also comprise the step of positioning a top closure piece over a top of a topmost construction block to cover a top portion thereof, including the top openings of the hollows of the support members thereof.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which.

DETAILED DESCRIPTION OF EMBODIMENTS

Figure 1:
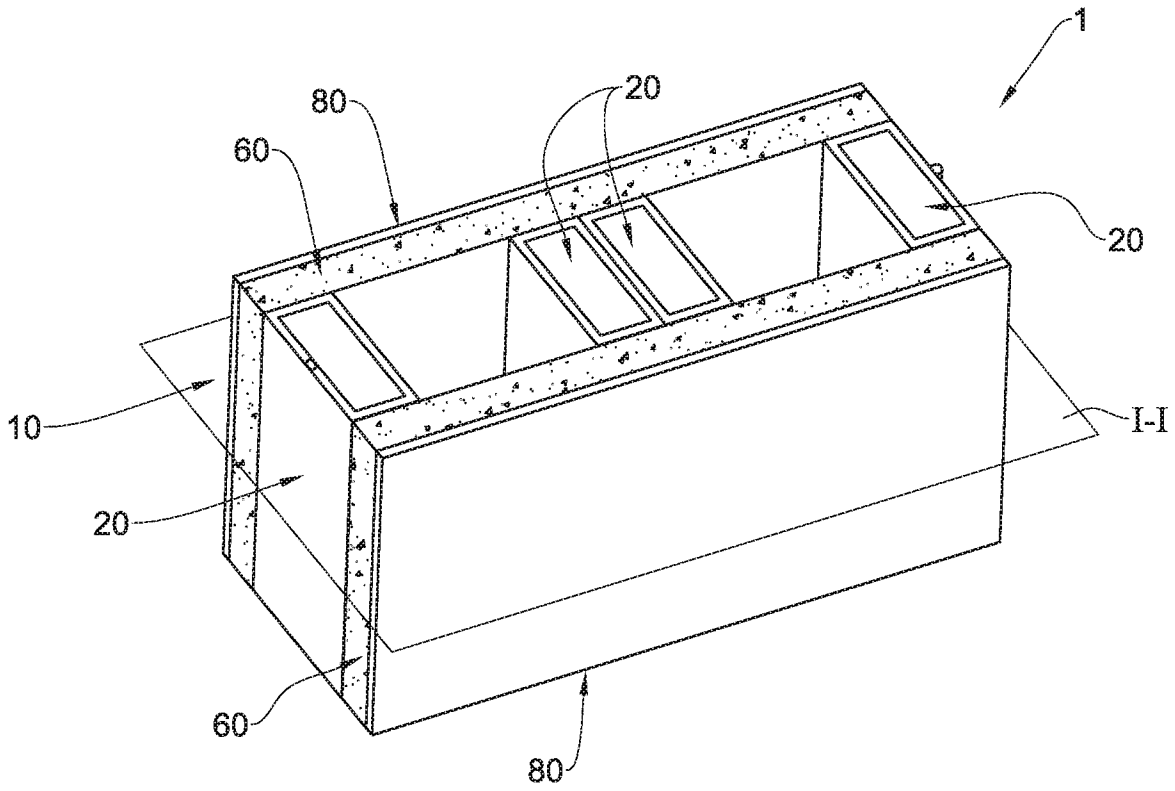
FIG. 1 is a schematic isometric view of a construction block according to the subject matter of the present application.

Attention is first drawn to FIG. 1 in which a construction block is shown, generally designated 1. The construction block comprises a support structure 10 constituted by a plurality of support members 20, onto which support structure 10 there are fitted two panels 60, each being covered by a cover panel 80.

As observed from FIG. 1, the support structure 10 comprises four support members 20—one support member at each end of the construction block 1, serving as an end support member, and two adjoined support members at the middle of the block 1, serving as intermediate support members. This gives rise to two main cavities 3, each being formed between the middle support members 20 and each of the respective end support members 20 at each end of the block 1.

Figure 2A:
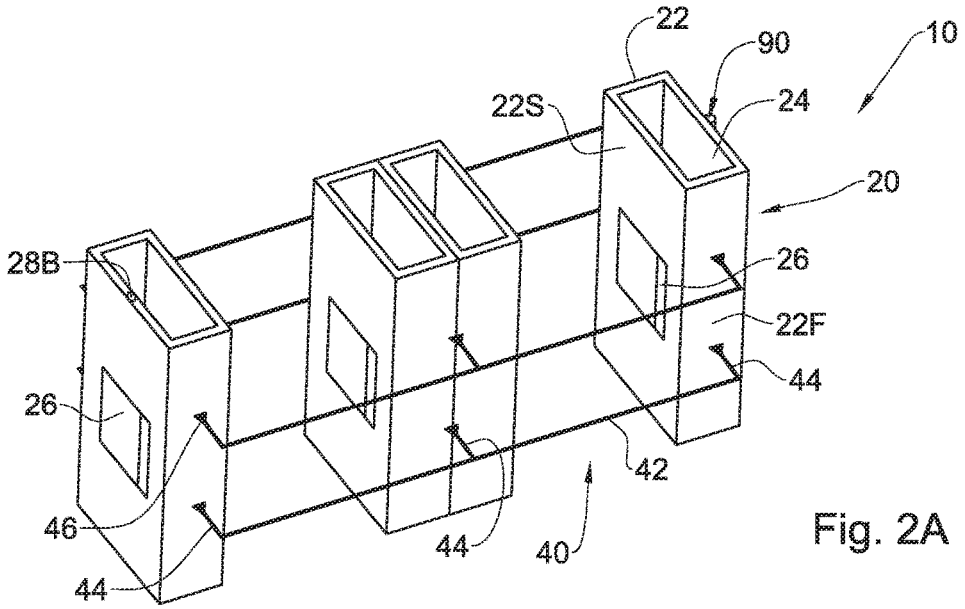
FIG. 2A is a schematic isometric view of a support structure used in the manufacture of the construction block shown in FIG. 1.

With further attention being drawn to FIG. 2A, the support structure 10 is shown comprising the four support members 20, each support member 20 comprising a main body 22 made of bent sheet metal, thereby forming an inner cavity 24 of the support member 20. Each support member has a first, front face 22F, an opposed rear face 22R, and two side faces 22S extending therebetween. In addition, the support member 20 is also formed with a utility channel 26 extending between two openings in the side walls 22S.

The right-most end support member 20 also comprises a securing pin 90 extending vertically along the outside side surface 22S of the support member 20, and the left-most end support member 20 comprises a securing port 28B extending vertically through side surface 22S of the support member 20, and configured for receiving therein the securing pin 90.

The four support members 20 are fixedly attached to each other by a support frame 40, made of several metal struts 42, and connected to the support members 20 via welding of extensions 44 thereof. It is noted that the support frame 40 extends outside the boundary of the support members 20, the purpose of which will be discussed in detail with respect to FIG. 2B.

Figure 2B:
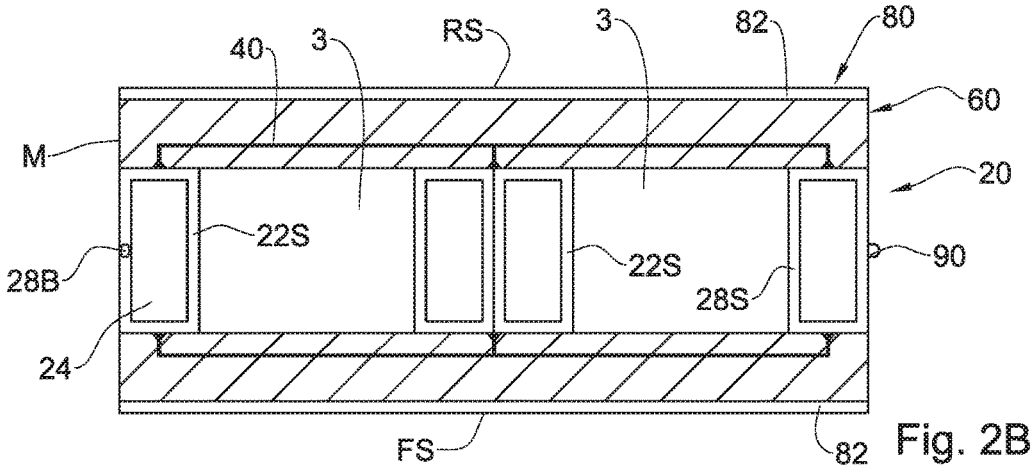
FIG. 2B is a schematic longitudinal cross-section view of the construction block shown in FIG. 1, taken along a plane I-I.
Figure 2C:
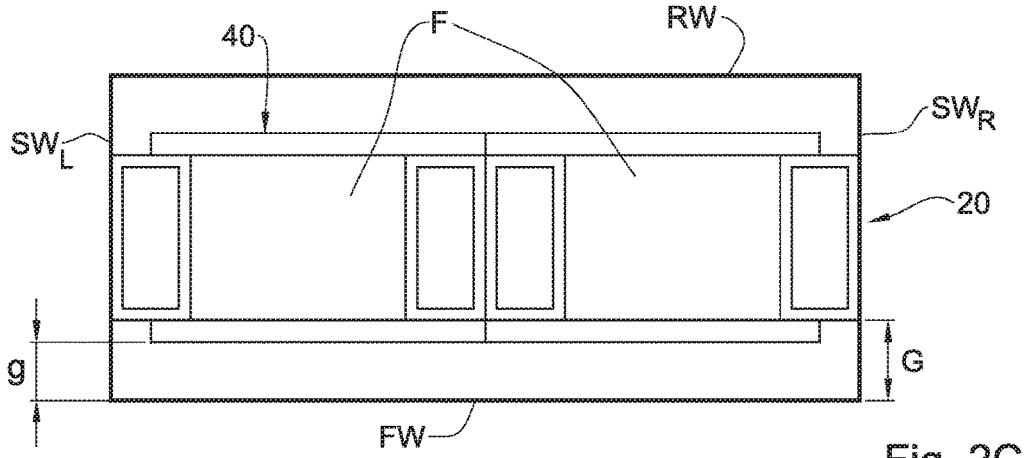
FIG. 2C is a schematic top view of the support structure shown in FIG. 2A, when placed in a mold for the manufacture of the construction block shown in FIG. 1.

With additional reference being made to FIGS. 2B and 2C, in manufacture of the construction block shown in FIG. 1, the support structure 10 is placed in a rectangular mold M corresponding in shape to that of the support structure 10 (different construction blocks may require a different support structures and mold) comprising a right-side wall $SW_R$, a left-side wall $SW_L$ opposite thereto, a front wall FW, and a rear wall RW extending therebetween.

The arrangement is such that the external side 22S of the right-end support member 20 is flush against the inner surface of the right-side wall $SW_R$ of the mold M and the external side 22S of the left-end support member 20 is flush against the inner surface of the left-side wall $SW_L$ of the mold M. The front face 22F and the rear face 22R of the support members 20 are spaced at a gap distance G from the respective front wall FW and rear wall RW of the mold M. It is noted that the front wall FW and the rear wall RW of the mold M are also spaced at a gap distance g<G from the struts 42 of the support frame 40.

Thereafter, two rectangular filler blocks F are placed within the two main cavities 3 between the end support members 20 and the intermediate support members 20, and the mold is then filled with a foam material according to the required properties of the panels 60. As a result, the foam material fills the entire gap distance G between the support members and the respective front and rear walls FW, RW, embedding therein the support frame 40.

Once the foam material hardens, the mold M and filler blocks F can be removed (leaving therein the two main cavities 3), yielding the basic construction block 1, a cross-section of which is shown in FIG. 2B. Cover panels can also be mounted on the front and rear foam panels 60 as shown. In this position, it is observed that the metal support frame 40 resides within the hardened foam material thereby reinforcing it. In addition, it also serves for firm and fixed attachment between the foam panels 60 and the support members 20 of the support structure 10.

Furthermore, the embedding of the support frame 40 within the panels 60 eliminates the need to use external fitting means such as bolts, screws, rods etc. in order to attach ready-made foam panel to a support structure, thereby simplifying the process and allowing more versatile design of the construction blocks 1.

Figure 3B:
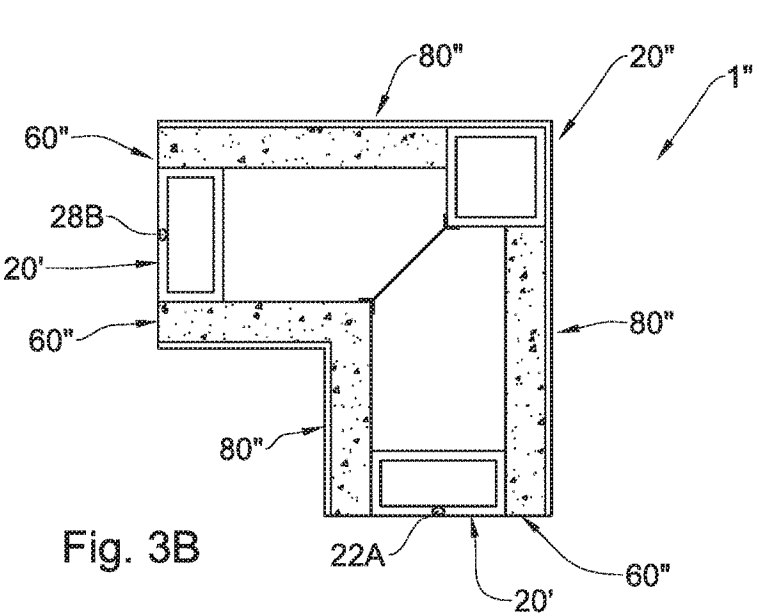
FIGS. 3A to 3C are schematic top and isometric views of different designs of construction blocks according to the subject matter of the present application.
Figure 3D:
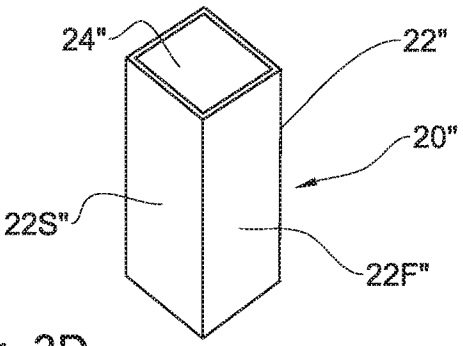
FIG. 3D is a schematic isometric view of a support member used in the constructions block shown in FIG. 3B.
Figure 3A:
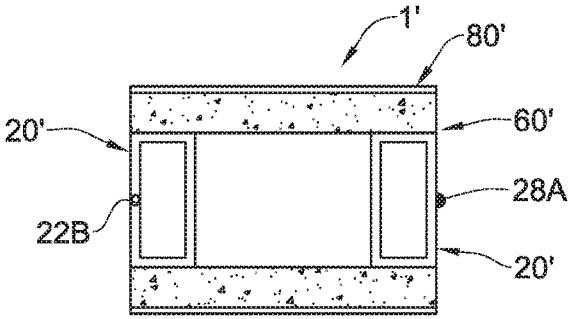
Figure 3C:
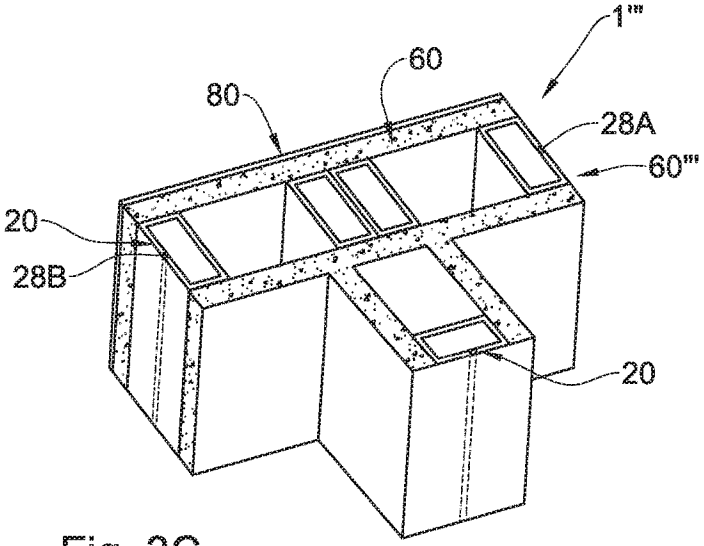

With reference being made to FIGS. 3A to 3C, three additional examples of construction blocks are shown, designated 1', 1" and 1'". Similar designation numbers were used for similar elements of construction block 1, so that the support members 20', 20" and 20'" are equivalent to support member 20 of construction block 1 etc.

Construction block 1' is a half-length block, comprising only a right-end and a left-end support members 20', construction block 1" is an L-shaped construction block which further comprises a square shaped support member 20", and construction block 1'" is a T-shaped construction block.

It is appreciated that since the construction blocks 1, 1', 1" and 1'" are not formed as a support structure onto which ready-made panels are mounted, the support structures 10, 10', 10", and 10'" can be placed within a proper corresponding mold M, M', M", M'" (chosen according to the final shape and dimensions of the construction block) and provide the suggested designs.

Figure 4A:
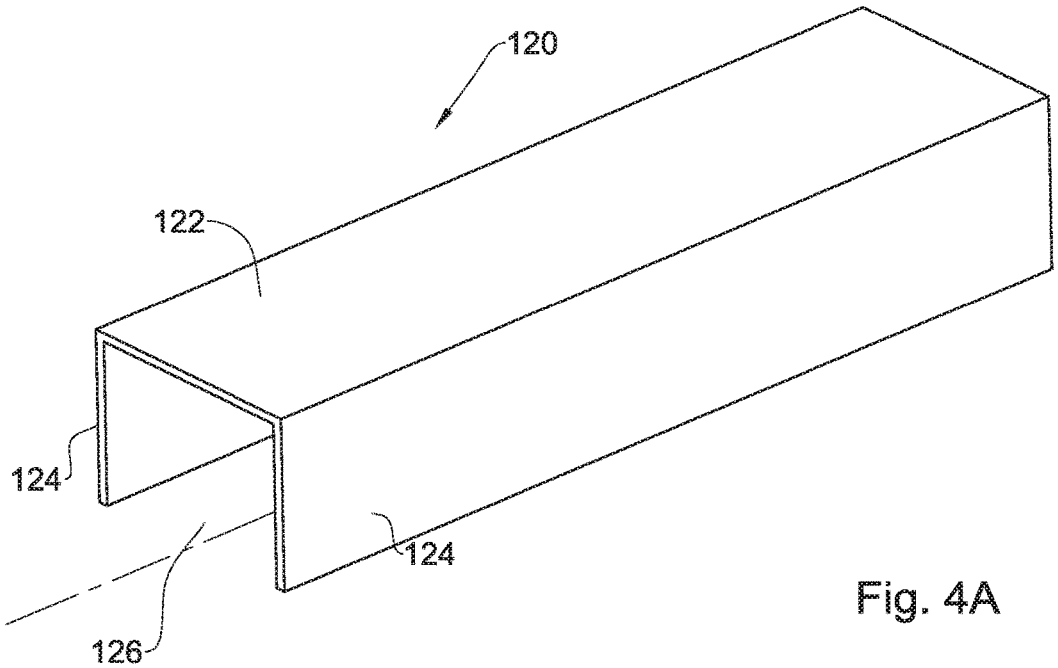
FIG. 4A is a schematic isometric view of a top closure used in conjunction with the construction block shown in FIG. 1.
Figure 4B:
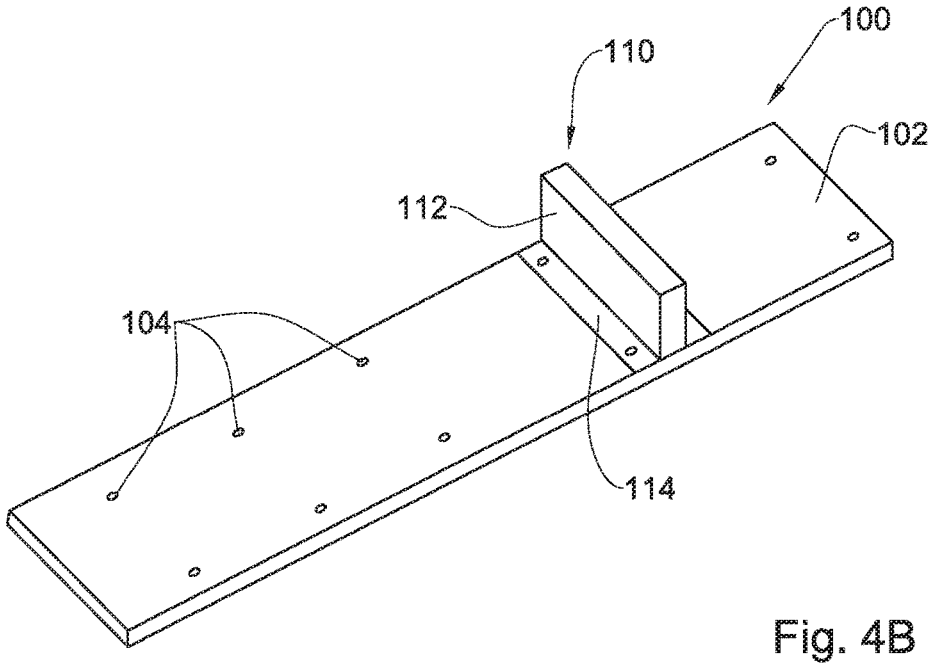
FIG. 4B is a schematic isometric view of a bottom base used in conjunction with the construction block shown in FIG. 1.

Turning now to FIGS. 4A and 4B, a base plate 100 and a top cover plate 120 are shown, configured for being used in construction of a wall structure using a plurality of construction blocks 1. The cover plate 120 will be discussed later in connection with FIG. 8A.

Figure 5A:
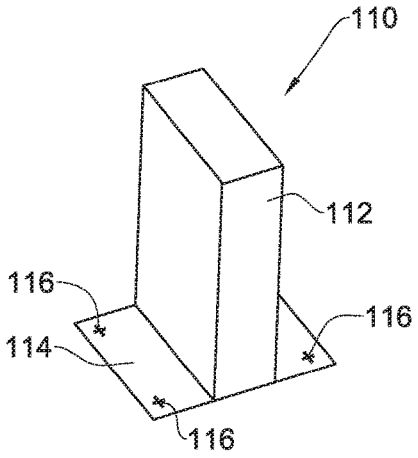
FIGS. 5A and 5B are schematic isometric views of base tenon elements used in the bottom base shown in FIG. 4B.
Figure 5B:
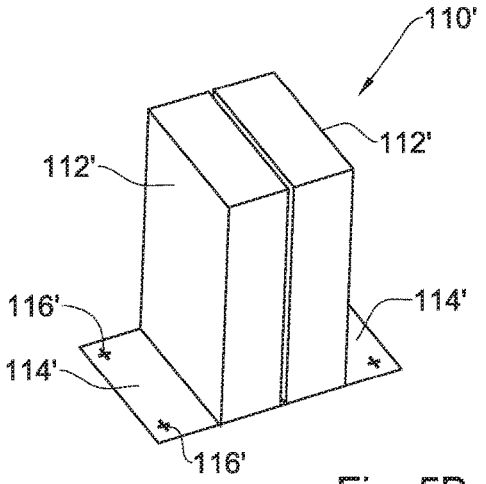

The base plate 100 is in the form of a flat panel 102 comprising slots 104 configured for allowing fastening of the panel 102 to a base surface such as a floor or ground. The panel 102 is formed with at least one base tenon 110 comprising a body 112 projecting from the panel 102 and two flange portions 114 affixed to the panel 102 by fastening means 116 (shown FIGS. 5A, 5B). Specifically, the example shown in FIG. 5A can be used for being accommodated within a hollow of a single support member 20, corresponding, for example, to the construction block of FIG. 3A, or any end support member, while the example shown in FIG. 5B can be received within two adjoined support member 20 simultaneously, corresponding, for example, to the construction block of FIG. 1.

Figure 7:
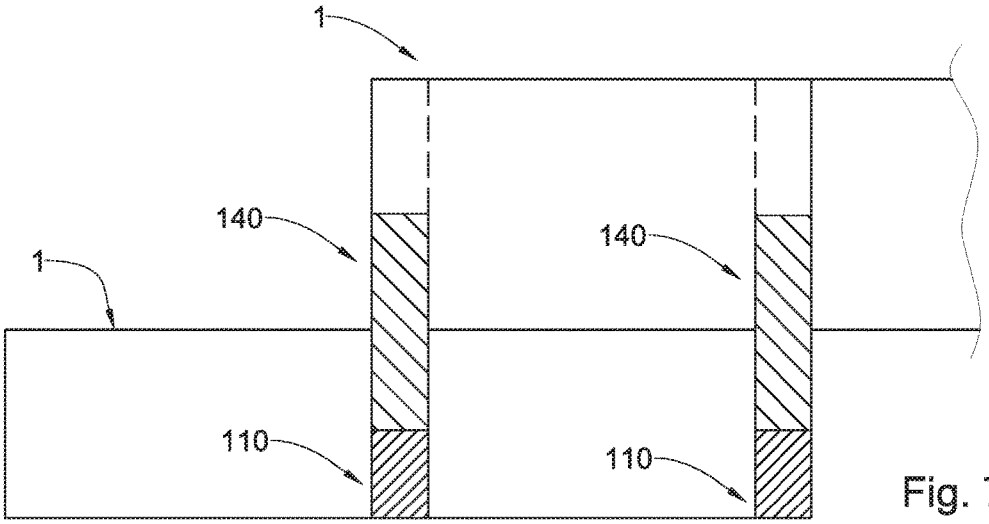
FIG. 7 is a schematic front view of a portion of a structure made of a plurality of construction blocks as shown in FIG. 1.

With additional reference being made to FIG. 7, in construction of a wall structure, the base panel is fitted to the floor and/or ground and a first construction block 1 is mounted thereon so that the base tenon 110 is fitted inside one of the cavities 24 of a support member 20 of the construction block 1. In this position, the base tenon 110 takes up half the height of the support member 20. It is noted that the dimensions of the base tenon 110 correspond to the dimensions of the cavity 24, so that it fully fills it up, forming a part of a whole solid structure.

Therafter, linking tenon elements 140 are placed in the cavities accommodating the base tenon elements 110. Each linking tenon 140 is equal in length to the height of the support member 20, so that when it is placed within the respective cavity 24, half its length is accommodated within the cavity 24 (the other half being occupied by the base tenon 110), and the other half projects vertically to receive the following construction block 1.

In this manner, an entire wall structure can be construction in a lego-like manner. One of the advantages of such an easy and modular construction lies in the fact that no support or load-bearing pillars are required. Specifically, once a set of cavities of support members 20 of different construction blocks 1 are vertically aligned, and completely filled with linking tenon elements 140, those tenon elements then constitute a vertical load bearing pillar of the wall structure. Further explanations regarding this matter will be provided with respect to FIG. 8A.

Figure 6:
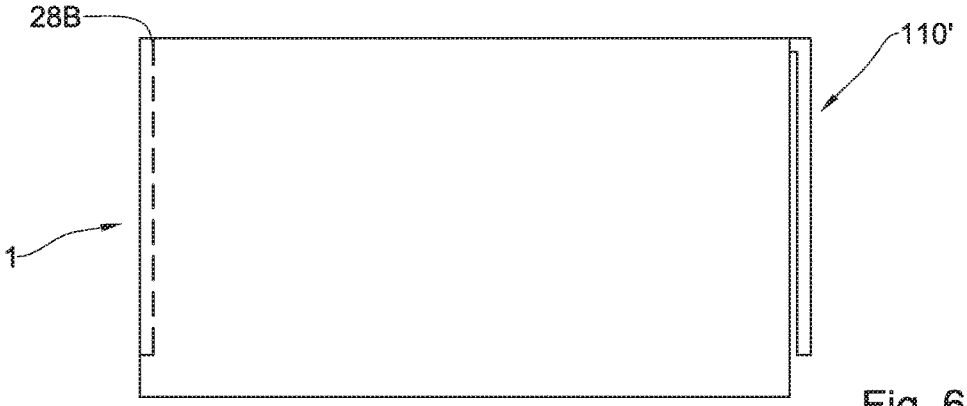
FIG. 6 is a schematic front view of the construction block shown in FIG. 1, comprising a security pin arrangement.

Turning now to FIG. 6, each construction block can comprise a securing pin 90 extending along the outer side of one of its side walls. The arrangement is such that when two neighboring construction blocks 1 are mounted side by side, the securing pin 90 of one construction block is received within the securing port 28 of its neighboring construction block 1. This securing allows preventing displacement between the construction blocks 1. Furthermore, it also allows reducing the amount of vertical load bearing pillars (constituted by tenon elements), i.e. there is no need to feel each and every cavity 24 of the support members with tenon elements.

Reverting now to FIG. 4A, when the wall structure is formed, and the top most construction blocks are placed, the top cover 120 can be placed over the top row of construction blocks 1 so that to give it a closure and a nice finish, the flanges of the cover 120 overlapping with the sides of the construction block 1.

Figure 8A:
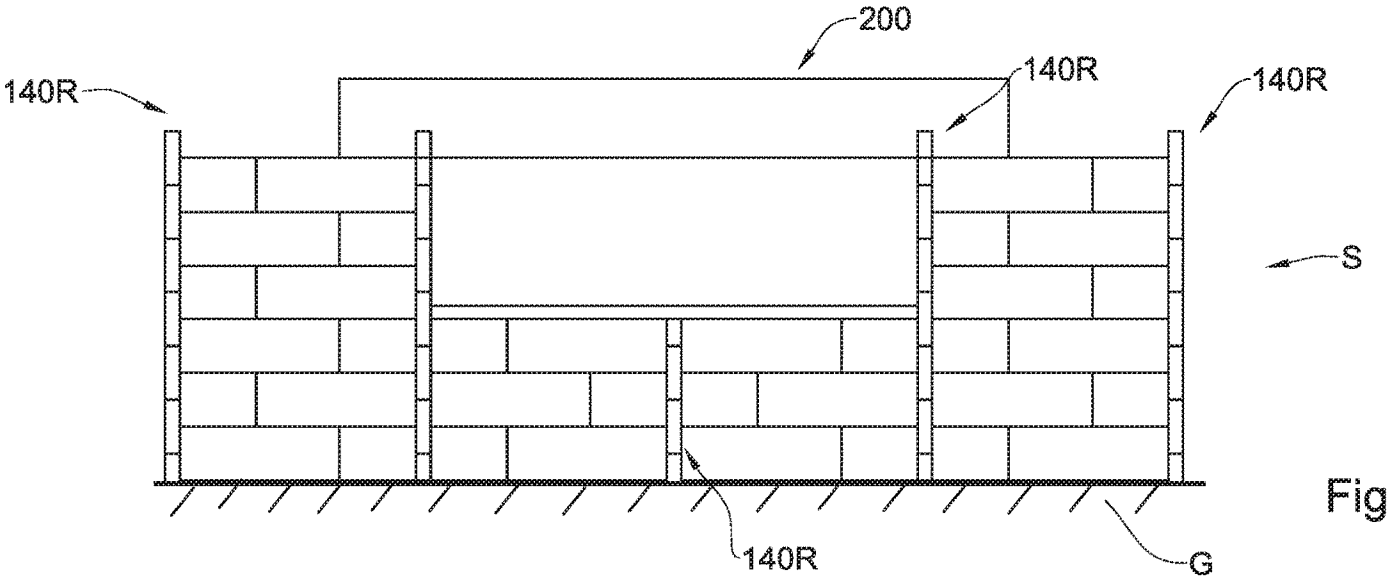
FIG. 8A is a schematic front view of a wall structure constructed using the construction block shown in FIG. 1, including a window space and a construction block serving as a lintel.
Figure 8B:
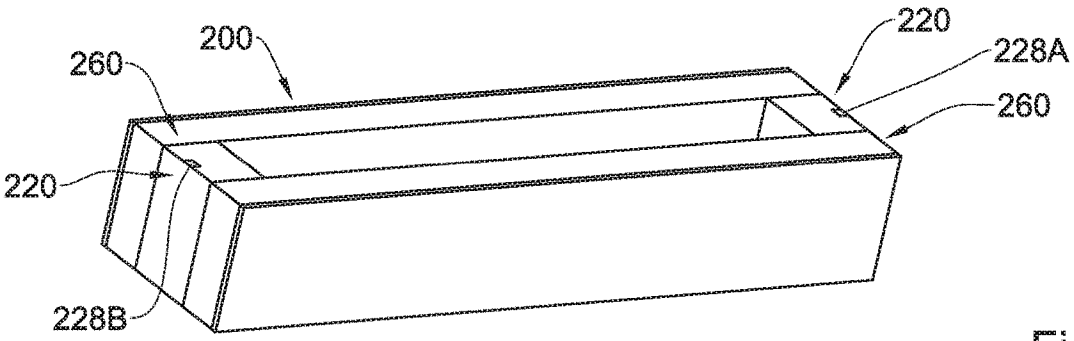
FIG. 8B is a schematic isometric view of the lintel shown in FIG. 8A.
Figure 9:
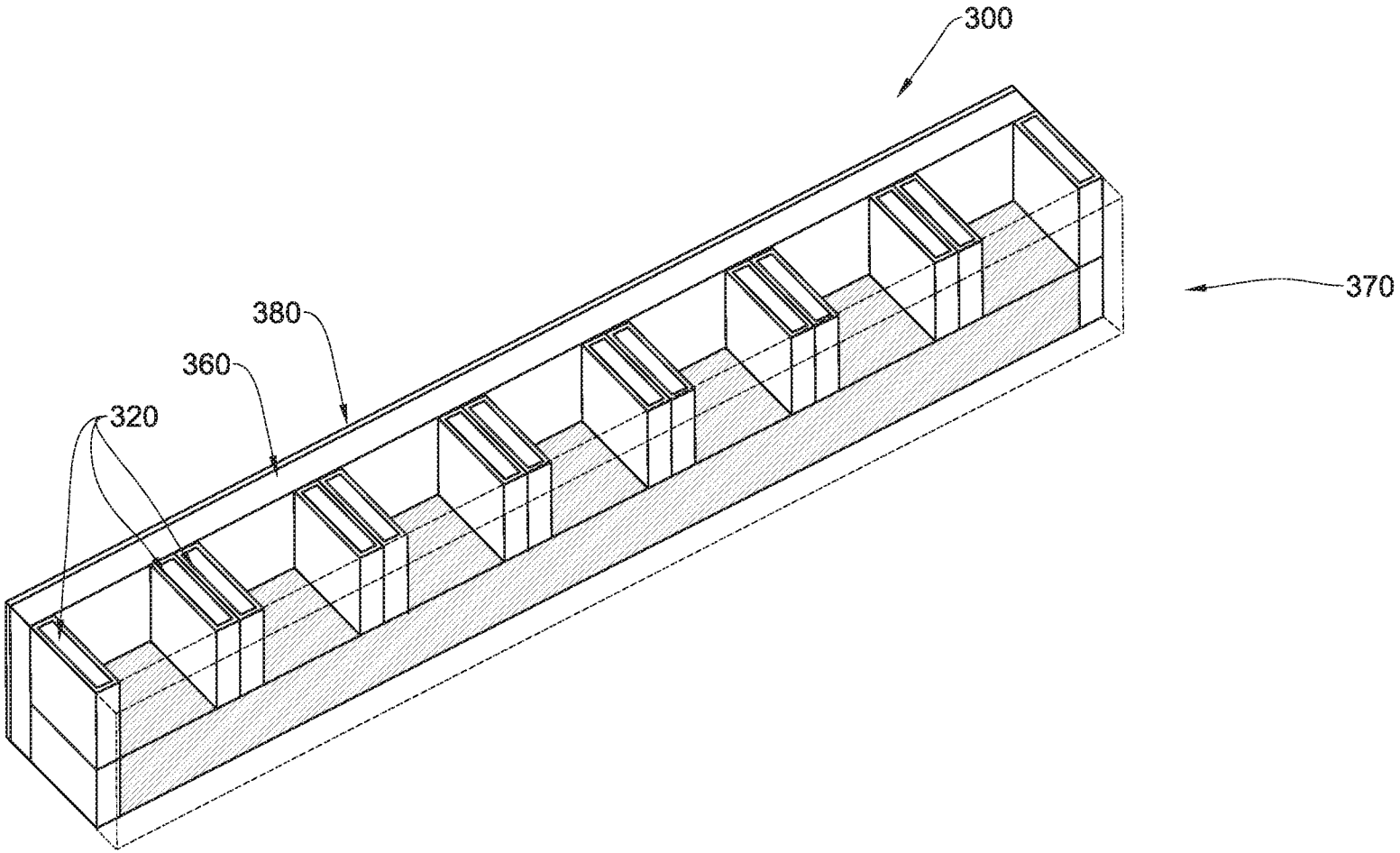
FIG. 9 is a schematic isometric view of a reinforced construction block according to the subject matter of the present application.

Reverting to FIG. 8A and with additional reference being made to FIGS. 8B and 9, a wall structure S can be designed to comprise an opening, for example for a window or a door (not shown). As such, in order to close off the wall vertically over the opening, a longer construction block can be required, referred herein as a lintel, and shown in FIG. 8A.

In essence, the lintel 200 is similar in design to the block 1' shown in FIG. 3A, only having a greater length. Such a lintel 200 comprises two support structure 220, panels 260 and a frame 240 (not seen).

The length of the lintel 200 is chosen according to the gap of the opening it is required to bridge, and specifically, so that, when placed over the opening as shown in FIG. 8A, the cavities of the support members 220 become aligned with the support channel formed by the support members of the other construction blocks 10.

In this manner, when being placed over the top end of the opening, bottom openings of the support members 220 of the lintel 200 can received therein the top portion of the tenon elements 140R which projects from the construction blocks 10 which are located at the level of the opening.

With particular reference being made to FIG. 9, another example of a lintel is shown, generally designated 300 and having a similar design to the lintel 200, with the exception that it comprises additional intermediate support members 320, disposed between the left-end and the right-end support members 320. In addition, the lintel 300 also comprises a base 370 extending half the height of the lintel 300, the base being made of a rigid material.

Using the lintel 300 allows for several advantages, some of which are:

- the lintel 300 can be attached to the remainder of the wall below it via tenon elements 140R via the intermediate support members 320, leaving and an additional portion of the lintel overlapping with the remainder of the wall structure S (as shown in FIG. 8A);
- the lintel 300 can be used for assembling, on top of it, additional construction blocks via the intermediate support members; and
- the rigid base can be configured for providing proper support for the remainder of the wall structure S built over the opening.

Those skilled in the art to which this invention pertains will readily appreciate that numerous changes, variations, and modifications can be made without departing from the scope of the invention, mutatis mutandis.

The invention claimed is:

1. A construction block, comprising:

two or more support members, each of the two or more support members having a first face and a second face opposite the first face, each of the two or more support members includes a hollow between the first and second faces, each of the two or more support members having a first opening, being defined by a first closed loop, facing in a direction transverse to a direction normal to the first and second faces and a second opening, being defined by a second closed loop, opposite to the first opening, the first and second openings being spaced therebetween, each of the first and second openings being configured for receiving therethrough at least a portion of a tenon element allowing the construction block to be mutually assembled with other construction blocks using said tenon element via said first and second openings;

a frame arrangement connecting the two or more support members to each other, said frame arrangement having at least one external segment extending from at least one of the first or second faces in a direction away from the hollow;

a first panel conterminous with the first faces of the two or more support members; and a second panel conterminous with the second faces of the two or more support members;

wherein at least a portion of the at least one external segment of the frame arrangement is contained within one of the first or second panels.

2. The construction block of claim 1, wherein said hollow extends an entire length of the support member, and wherein the first opening is at a top portion of the support member and the second opening is at a bottom portion of the support member.

3. The construction block of claim 1, wherein the first faces of the two or more support members are oriented flush with respect to each other and the second faces of the two or more support members are oriented flush with respect to each other.

4. The construction block of claim 1, wherein said two or more support members include four support members arranged such that the first two of the four support members are spaced from one another defining a space, and the second two support members are disposed in said space.

5. The construction block of claim 1, wherein said two or more support members include a plurality of support members including a first end support member and a second end support member spaced from one another to define a space, and a plurality of support member pairs each including two conjoined support members disposed sequentially in said space.

6. The construction block of claim 1, wherein each of said two or more support members is in the form of a sheet metal structure.

7. The construction block of claim 6, wherein the sheet metal structure is made of steel.

8. The construction block of claim 1, wherein at least one of the two or more support members includes a pin slot configured for receiving therein a securing pin.

9. The construction block of claim 8, wherein said pin slot is formed on an end side face of the at least one of the two or more support members.

10. The construction block of claim 1, wherein at least one of the two or more support members includes a first side wall with a first side opening and a second side wall opposite the first side wall, with a second side opening, defining a cross-channel between the first and the second side wall.

11. The construction block of claim 10, wherein said cross-channel is configured for passing therethrough of at least one of piping or wiring.

12. The construction block of claim 10, wherein said cross-channel is not obstructed by the first and the second panel.

13. A wall structure comprising two or more of the construction blocks of claim 1, said wall structure further comprising at least one said tenon element having a first portion thereof received in the hollow of one of the two or more support members of a first of the two or more construction blocks and a second portion thereof received in the hollow of one or more of the two support members of a second of the two or more construction blocks, thereby holding the blocks together.

14. The wall structure of claim 13, wherein the two or more of the construction blocks are arranged without offset such that the first portion of the tenon is received within the hollow of a first support member of the first of the two or more construction blocks through a top opening thereof and the second portion thereof is received in the hollow of a corresponding first support member of the second of the two or more construction blocks through a bottom opening thereof, thereby holding the blocks together.

15. The wall structure of claim 13, wherein the two or more construction blocks are arranged at an offset with respect to one another, such that the first portion of the tenon is received within a hollow of a first support member of a first of the two or more construction blocks through a top opening thereof, and a second portion thereof received in a hollow of a support member of a second of the two or more construction blocks different than the first support member thereof, through a bottom opening thereof.

16. The wall structure of claim 13, further comprising a ground base configured for positioning thereon a first row of construction blocks, said base comprising a longitudinal plate formed with one or more base tenon elements disposed therealong and configured for being received within corresponding hollows of the support members through a bottom opening thereof.

17. A method of assembling the wall structure of claim 13, said method comprising:

providing said two or more of the construction blocks;

inserting the first portion of the at least one tenon element into the hollow of the support member of the first of the two or more construction blocks through a top opening thereof; and placing the second of the two or more construction blocks over the first of the two or more construction blocks so that the second portion of the tenon element is received within the hollow of the support member of the second of the two or more construction blocks through a bottom opening thereof, to form at least part of the wall structure.

18. The method of claim 17, further comprising inserting a securing pin into the wall structure so that a first portion thereof is received within a pin slot of a support member of the first of the two or more construction blocks and a second portion thereof is received within a pin slot of a support member of the second of the two or more construction blocks.

19. The method of claim 17, further comprising preliminary acts of:

providing a ground base configured comprising a longitudinal plate formed with one or more base tenon elements disposed therealong and configured for being received within corresponding hollows of the support members through the bottom openings thereof; and positioning at least one said construction block on said ground base so that the hollows of the two or more support members receive therein a portion of the base tenon elements through the bottom openings thereof.

20. The method of claim 17, further comprising positioning a top closure piece over a top of a topmost construction block to cover a top portion thereof, including the top openings of the hollows of the support members thereof.

* * * * *